United States Patent [19]

Venit

[11] 4,423,861

[45] Jan. 3, 1984

[54] ACROBATIC APPARATUS

[76] Inventor: Sharyn D. Venit, 2740 A Folsom St., San Francisco, Calif. 94110

[21] Appl. No.: 283,641

[22] Filed: Jul. 15, 1981

[51] Int. Cl.[3] ..... A63B 7/02

[52] U.S. Cl. ..... 272/61; 248/165

[58] Field of Search ..... 272/85, 61, 109, 62, 272/63; D21/235, 246

[56] References Cited

U.S. PATENT DOCUMENTS 567,543 9/1896 Kinemann et al. ..... 272/61

638,033 11/1899 Stirk ..... 272/61

1,975,463 10/1934 Jones ..... 272/61

FOREIGN PATENT DOCUMENTS 443086 1/1968 Switzerland ..... 272/85

*Primary Examiner*—Richard C. Pinkham

*Assistant Examiner*—Stephen R. Crow

[57] ABSTRACT

Two pentacles, each constructed of five rods, are joined at the points by five hardwood dowels which serve as a matrix of trapezes when the apparatus is suspended to swing from a fixed bar mount or from ceiling mounts.

3 Claims, 4 Drawing Figures

ACROBATIC APPARATUS

FIELD OF INVENTION

The present invention relates to children's play structures and to gymnastic exhibition equipment used by trained acrobats in public performances.

BACKGROUND OF THE INVENTION

Swings, trapezes, parallel bars, and climbers of various types are well established in the history of human invention. The current design is unique and novel in that it combines all these concepts in a single apparatus. This design was developed for use by children in free play, gymnastics classes in special exercises, or trained acrobats in exhibitions. The design accomodates use by more than one subject at a time, as well as complex demonstrations by an individual.

SUMMARY OF THE INVENTION

It is therefore an object of the present invention to provide an unusual display apparatus to capture and hold the attention of the audience during an acrobatic or gymnastic exposition.

It is another object of the present invention to accomodate two or more performers simultaneously.

It is, further, an explicit object of the current invention to inspire performers in creative exercises on a matrix of swinging bars, and to attract children to play on a novel device.

BRIEF DESCRIPTION OF THE DRAWINGS

For a better understanding of the invention, possible embodiments thereof will now be described with reference to the attached drawings; it being understood that such embodiments are intended as merely exemplary and in no way limitative.

DESCRIPTION OF THE PREFERRED EMBODIMENT

Figure 1:
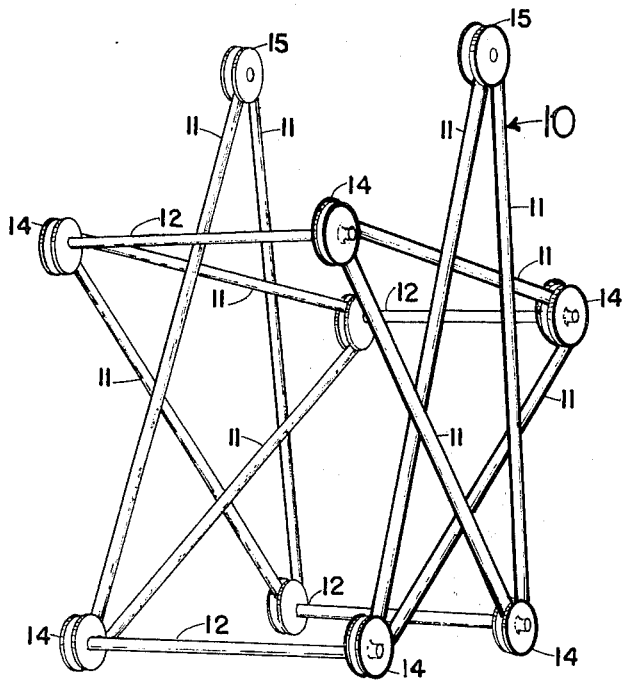
FIG. 1 is a perspective view of an embodiment of the basic pentangular module in accordance with the present invention.

A pentangular module in accordance with the present invention is shown in FIG. 1. Such a module 10, which may be constructed in various sizes, is formed of a plurality of pieces of metal pipe 11 and hardwood dowels 12 which meet at corner elements 14, 15. It will be seen that the module 10 is composed of two five-pointed metal frames which are joined at four corresponding corners 14 by four hardwood dowels 12, the topmost corners 15 of each pentacle being the points at which the module is connected to mounts as will be seen in FIG. 2 and FIG. 3.

It will be seen that each module 10 has 10 corners which, in the illustrated embodiment, comprise the corner pieces 14. Each corner is formed by the juncture of two pipes 11 and a hardwood dowel 12 which, in the illustrated embodiment, are individually bolted to such a corner piece 14. Thus each pipe 11 and dowel 12 is provided with two holes, such as punched holes or drilled holes, one being provided at each end.

Figure 4:
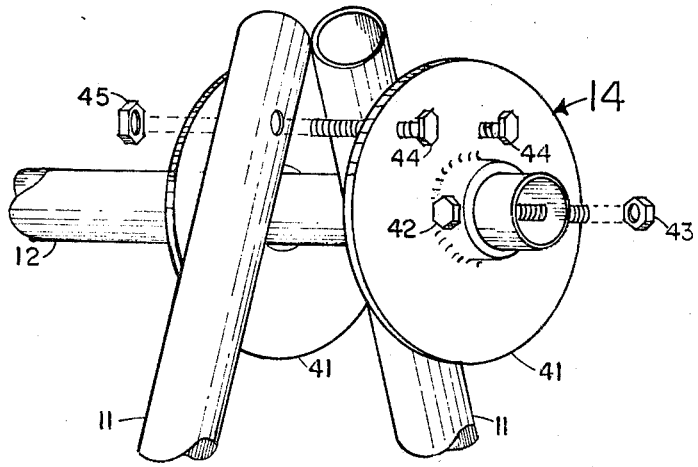
FIG. 4 is a detailed view showing an embodiment of a corner connection.

Noting FIG. 4, it is seen that the corner pieces 14 are each formed by two flanges 41, each of which is provided with two bolt holes on the disk and two bolt holes on the collar around the central opening through which the dowel 12 fits. Each dowel 12 is bolted to a corner piece 14 by a bolt 42 which passes through the hole in the end of the dowel 12 and through two corresponding holes in the collar of one flange 41, the bolt being secured with a suitable nut 43, such as a nut lock. Similarly, it is seen that each pipe 11 is bolted to the two flanges 41 by a bolt 44 which passes through the hole in the end of the pipe 11 and through a corresponding hole in the disk of the flange 41, the bolt being secured with a suitable nut 45, such as a lock nut.

Figure 2:
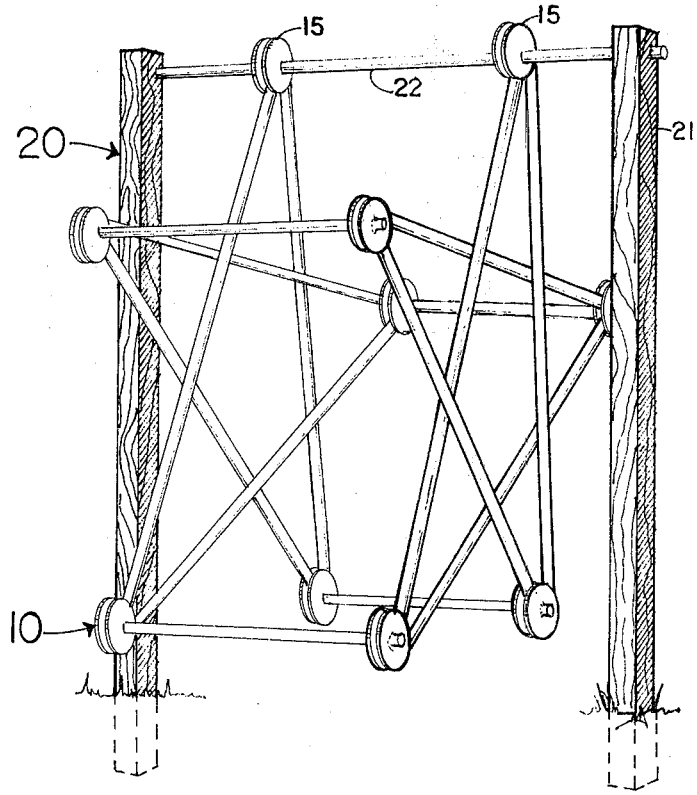
FIG. 2 is a view of the pentangular module mounted to a stand which is fixed in the ground.

Referring to FIG. 2, there is shown an embodiment in which the pentacle module 10 is mounted to a frame 20. The frame 20 is composed, in the illustrated embodiment, of two wooden beams 21 which are firmly planted in the ground, and a metal bar 22 which is supported by the beams 21 and from which the module 10 is suspended. It will be seen from FIG. 2 that each beam 21 is provided with a hole near the topmost end through which the metal bar 22 fits securely. The entire apparatus as shown in the illustrated embodiment is assembled by passing the metal bar 22 through the two corners 15 of the module 10 which have no hardwood dowel connections. The holes in the beams are positioned at a height above ground level which allows the module 10 to swing freely when suspended from the bar 22.

Figure 3:
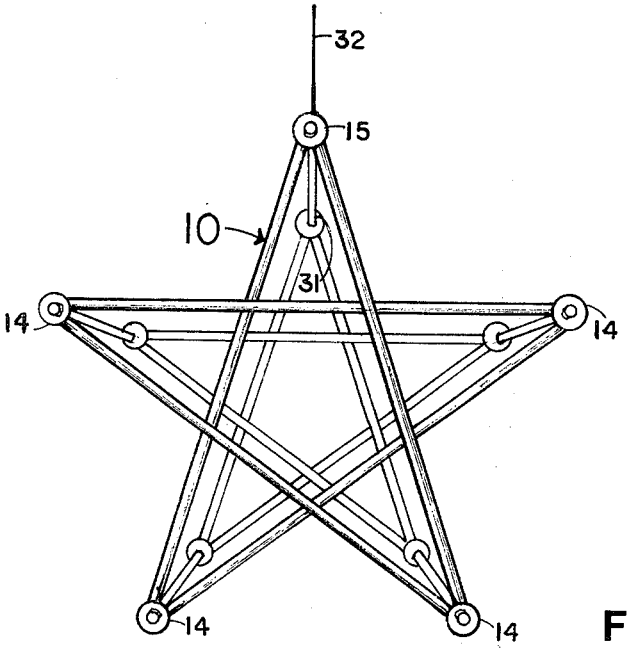
FIG. 3 is a view of the module suspended from an overhead mount.

Referring to FIG. 3, there is shown an embodiment in which the pentacle module 10 is mounted on a metal bar 31 which is suspended by chains or cables 32 from overhead.

It will be obvious to those skilled in the art that various changes may be made without departing from the scope of the invention, and the invention is not to be considered limited to to what is described above. For example, the metal poles of the frames and mounts may be replaced by wood, the entire design may be scaled larger or smaller, the fixed bar axis may be suspended from overhead, the corner joints may be welded rather than bolted, metal poles may be replaced by plastic poles of suitable strength. The dimensions of the construction are tailored to the size of the users: the distance between two non-adjacent dowels being approximately the same as the span reached by the user's extended arms.

What is claimed is:

1. An acrobatic apparatus comprising:

(a) two pentagonal frames, each frame comprising five strut members connected at their ends by corner pieces, said strut members being arranged to form, when viewed in side elevation, a five pointed star;

(b) four parallel dowels, each extending between two corresponding points of said pentagonal frames connected to said corner pieces;

(c) a bar, means connecting the ends of said bar to the uppermost corresponding points of said frames; and (d) means supporting said bar spaced above the ground whereby said frame may swing freely when a user's body is engaged with one of said dowels.

2. An acrobatic apparatus in accordance with claim 1, wherein said means supporting said bar comprises two spaced vertical members engaging the ground at their lower ends and supporting said bar at their upper ends.

3. An acrobatic apparatus in accordance with claim 1, wherein said means supporting said bar comprises flexible means for suspending said bar from overhead.

* * * * *